US010367249B2

(12) United States Patent
Sub Shin

(10) Patent No.: US 10,367,249 B2
(45) Date of Patent: Jul. 30, 2019

(54) TUNABLE ANTENNA SYSTEMS, DEVICES, AND METHODS

(71) Applicant: wiSpry, Inc., Irvine, CA (US)

(72) Inventor: Joung Sub Shin, Irvine, CA (US)

(73) Assignee: WISPRY, INC., Irvine, CA (US)

( * ) Notice: Subject to any disclaimer, the term of this patent is extended or adjusted under 35 U.S.C. 154(b) by 85 days.

(21) Appl. No.: 14/664,462

(22) Filed: Mar. 20, 2015

(65) Prior Publication Data

US 2015/0270608 A1 Sep. 24, 2015

Related U.S. Application Data

(60) Provisional application No. 61/968,930, filed on Mar. 21, 2014.

(51) Int. Cl.

| | |
|---|---|
| ***H01Q 1/24*** | (2006.01) |
| ***H01Q 9/04*** | (2006.01) |
| ***H01Q 1/50*** | (2006.01) |
| ***H01Q 9/06*** | (2006.01) |
| ***H01Q 7/00*** | (2006.01) |
| ***H01Q 9/42*** | (2006.01) |
| ***H01Q 5/335*** | (2015.01) |

(52) U.S. Cl.

CPC ..... *H01Q 1/243* (2013.01); *H01Q 1/50* (2013.01); *H01Q 5/335* (2015.01); *H01Q 7/00* (2013.01); *H01Q 9/04* (2013.01); *H01Q 9/06* (2013.01); *H01Q 9/42* (2013.01)

(58) Field of Classification Search

CPC .. H01Q 1/50; H01Q 9/04; H01Q 9/06; H01Q 9/42; H01Q 5/335; H01Q 1/243; H01Q 7/00

See application file for complete search history.

(56) References Cited

U.S. PATENT DOCUMENTS

| | | | |
|---|---|---|---|
| 5,231,407 | A | 7/1993 | McGirr et al. |
| 6,061,024 | A | 5/2000 | McGirr et al. |
| 6,333,719 | B1 | 12/2001 | Varadan et al. |
| 8,289,103 | B2 | 10/2012 | Yamakawa et al. |

(Continued)

FOREIGN PATENT DOCUMENTS

| | | | |
|---|---|---|---|
| CN | 103337702 | A | 10/2013 |
| CN | 103441331 | A | 12/2013 |

(Continued)

OTHER PUBLICATIONS

Rowell et al., "A Capacitively Loaded PIFA for Compact Mobile Telephone Handsets," IEEE Transactions on Antennas and Propagation, vol. 45, No. 5, May 1997.

(Continued)

*Primary Examiner* — Hoang V Nguyen

(74) *Attorney, Agent, or Firm* — Jenkins, Wilson, Taylor & Hunt, P.A.

(57) ABSTRACT

The present subject matter relates to tunable antenna systems and methods in which a tunable band-stop circuit is provided in communication between a signal node and an electrically small antenna having a largest dimension that is substantially equal to or less than one-tenth of a length of a wavelength corresponding to a frequency within a communications operating frequency band. The tunable band-stop circuit can be tunable to adjust a band-stop frequency.

18 Claims, 6 Drawing Sheets

(56) References Cited

U.S. PATENT DOCUMENTS

| | | | | |
|---|---|---|---|---|
| 8,902,113 | B2 | 12/2014 | Morris, III | |
| 2002/0140612 | A1 | 10/2002 | Kadambi et al. | |
| 2002/0183013 | A1 | 12/2002 | Auckland et al. | |
| 2003/0207678 | A1 | 11/2003 | Kwon | |
| 2004/0087341 | A1 | 5/2004 | Edvardsson | |
| 2005/0040909 | A1* | 2/2005 | Waight ..... | H03H 7/0153 333/17.1 |
| 2005/0057399 | A1 | 3/2005 | Kipnis et al. | |
| 2005/0164647 | A1 | 7/2005 | Shamsaifar | |
| 2007/0049213 | A1 | 3/2007 | Tran | |
| 2008/0107093 | A1 | 5/2008 | Meiyappan et al. | |
| 2010/0118921 | A1 | 5/2010 | Abdelmonem et al. | |
| 2011/0142178 | A1 | 6/2011 | Huang et al. | |
| 2011/0294443 | A1 | 12/2011 | Nohra et al. | |
| 2013/0214979 | A1* | 8/2013 | McMilin ..... | H01Q 9/42 343/750 |
| 2014/0055210 | A1 | 2/2014 | Black et al. | |

FOREIGN PATENT DOCUMENTS

| | | | |
|---|---|---|---|
| CN | 103 563 261 | A | 2/2014 |
| CN | 102 017 300 | B | 9/2015 |
| EP | 3120413 | A1 | 1/2017 |
| EP | 2269267 | B1 | 12/2017 |
| JP | 2011/024254 | A | 2/2011 |
| KR | 2005/0069746 | A | 7/2005 |
| WO | WO 2007/025309 | A1 | 3/2007 |
| WO | WO 2007/149954 | A1 | 12/2007 |
| WO | WO 2008/020382 | A2 | 2/2008 |
| WO | WO 2015/143377 | A1 | 9/2015 |

OTHER PUBLICATIONS

Nishio et al., "A Study of Wideband Built-In Antenna Using RF-MEMS Variable Capacitor for Digital Terrestrial Broadcasting," Antennas and Propag. Soc. Int'l Symposium 2006, IEEE Jan. 1, 2006—ISBN: 978-1-4244-0123-9.

Non-Final Office Action for U.S. Appl. No. 12/431,373 dated Aug. 3, 2011.

European Search Report for Application No. 09 73 9590 dated Nov. 7, 2011.

Final Office Action for U.S. Appl. No. 12/431,373 dated Feb. 9, 2012.

Non-Final Office Action for U.S. Appl. No. 12/431,373 dated Oct. 2, 2012.

Chinese Office Action for Application No. 200980113013.7 dated Dec. 5, 2012.

Final Office Action for U.S. Appl. No. 12/431,373 dated Feb. 15, 2013.

Advisory Action for U.S. Appl. No. 12/431,373 dated Apr. 25, 2013.

Chinese Office Action for Application No. 200980113013.7 dated Aug. 2, 2013.

Non-Final Office Action for U.S. Appl. No. 12/431,373 dated Sep. 26, 2013.

Final Office Action for U.S. Appl. No. 12/431,373 dated Feb. 12, 2014.

Chinese Office Action for Application No. 200980113013.7 dated Apr. 17, 2014.

Notice of Allowance for U.S. Appl. No. 12/431,373 dated Aug. 18, 2014.

Chinese Decision of Rejection for Application No. 200980113013.7 dated Nov. 26, 2014.

International Search Report for Application No. PCT/US2015/021842 dated Jun. 26, 2015.

Chinese Notice of Intent to Grant for Application No. 200980113013.7 dated Jun. 2, 2015.

European Office Action for Application No. 09 739 590.9, dated Aug. 4, 2015.

European Notice of Publication for European Application No. 15764577 dated Jan. 4, 2017.

IPRP and Written Opinion for Application No. PCT/US2015/021842 dated Sep. 21, 2016.

European Summons to Attend Oral Proceedings for Application No. 09739590 dated Sep. 22, 2016.

International Search Report for Application No. PCT/US2013/054461 dated Oct. 30, 2013.

Minutes of the Oral Proceedings before the Examining Division for Applicaiton No. 09739590 dated Jun. 29, 2017.

European Notice of Intent to Grant for Application No. 09739590 dated Jul. 7, 2017.

Extended European Search Report for European Application No. 15764577 dated Oct. 4, 2017.

Decision to grant a European patent for European Application No. 09739590.9 dated Nov. 16, 2017.

Chinese Office Action for Chinese Application No. 2015800151822 dated Jun. 29, 2018.

Chinese Office Action for Chinese Application No. 201580015182.2 dated Dec. 11, 2018.

* cited by examiner

TUNABLE ANTENNA SYSTEMS, DEVICES, AND METHODS

PRIORITY CLAIM

The present application claims the benefit of U.S. patent application Ser. No. 61/968,930, filed Mar. 21, 2014, the disclosure of which is incorporated herein by reference in its entirety.

TECHNICAL FIELD

The subject matter disclosed herein relates generally to radio frequency antennas. More particularly, the subject matter disclosed herein relates to the design, construction, and operation of tunable antennas.

BACKGROUND

In the mobile communications market, the number worldwide users and the increasing demand for a wide range of mobile services (e.g., including wireless voice telephony, mobile Internet access, fixed wireless Internet access, video calls, and mobile TV technologies) has driven the development of new generations of cellular standards having new frequency bands and higher data rates. To accommodate users on a variety of networks, one solution can be to particularly design mobile devices to be used with a specific network configuration. This approach can lead to manufacturing inefficiencies, however, as multiple variations of the same product would be needed to accommodate the multiple different mobile telecommunications standards.

As a result, it can be desirable for mobile devices to be compatible with more than one set of mobile telecommunications standards to provide manufacturing efficiency (e.g., 1 SKU for all global production) and device versatility. In particular, it is desirable for a mobile device to be able to operate within frequency bands associated with all of 2G (e.g., GSM/CDMA), 3G (e.g., EVDO/WCDMA), and 4G (e.g., LTE) technologies. In addition, further advancements in mobile technology (e.g., LTE, LTE-A, and 5G) will require additional expansions to the range of frequencies in which a mobile device will be expected to be operable. Furthermore, multiple antenna structures (e.g., MIMO, carrier aggregation) can be desired to provide additional functional advantages.

The ability to operate in such a wide range of frequencies can be limited, however, by the physical size of the wireless antenna. Especially in those systems that use multiple antennas in the mobile device, the amount of physical space required can be quite large. In addition, design constrains imposed by the continually shrinking size of modern mobile devices (e.g., slim, chic, curved, narrow bezel) can present a natural conflict with the volume needed to accommodate a multi-frequency antenna system. As a result, it would be advantageous to have an antenna system for advanced mobile technology that can better achieve a wide bandwidth with a small antenna volume.

SUMMARY

In accordance with this disclosure, tunable antenna systems, devices, and methods are provided. In one aspect, a tunable antenna system is provided in which a tunable band-stop circuit is provided in communication between a signal node and an electrically small antenna having a largest dimension that is substantially equal to or less than one-tenth of a length of a wavelength corresponding to a frequency within a communications operating frequency band. The tunable band-stop circuit can be tunable to adjust a band-stop frequency.

In another aspect, a method for tuning an electrically small antenna is provided. The method can comprise tuning a tunable band-stop filter connected to the electrically small antenna to adjust a system resonance for the tunable band-stop filter and the electrically small antenna within a desired low frequency band below a band-stop frequency without changing a system resonance for the tunable band-stop filter and the electrically small antenna within a desired high frequency band above the band-stop frequency.

In yet another aspect, a method for tuning an electrically small antenna can comprise connecting a tunable band-stop circuit between an electrically small antenna and a signal node, the electrically small antenna having a largest dimension that is substantially equal to or less than one-tenth of a length of a wavelength corresponding to frequency within a communications operating frequency band, and tuning the tunable band-stop circuit to adjust a band-stop frequency between the desired low frequency band and a desired high frequency band within the communications operating band.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides tunable antenna systems, devices, and methods. In particular, the tunable antenna systems, devices, and methods can tune a low band frequency while also maintaining good performance in a high band resonance. In some embodiments, for example, tunable antenna systems can be sized to be resonant at or about a desired high-band frequency (e.g., about 1.9 GHz). In addition, the systems can further be configured to be tunable to exhibit resonance at or about a desired low-band frequency (e.g., between about 700 MHz to 960 MHz, a range that include UMTS frequency bands B5, B8, B12, B13, and B17).

Figure 1A:
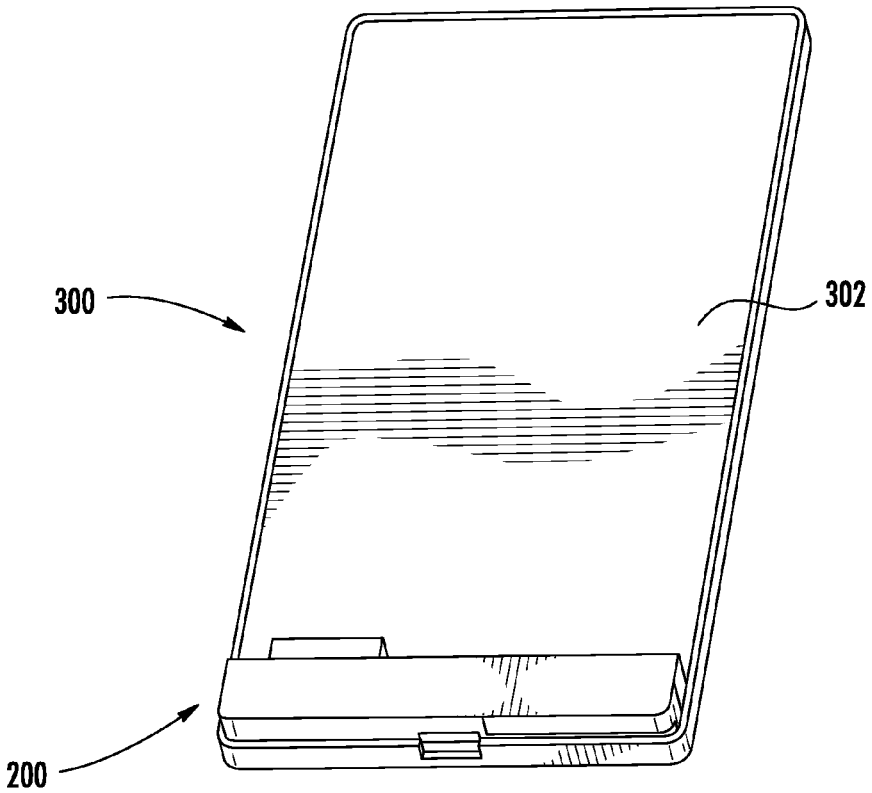
FIG. 1*a* is a from perspective view of a mobile communications device with its back face removed to show some of its internal components, including a tunable antenna system according to an embodiment of the presently disclosed subject matter.
Figure 1B:
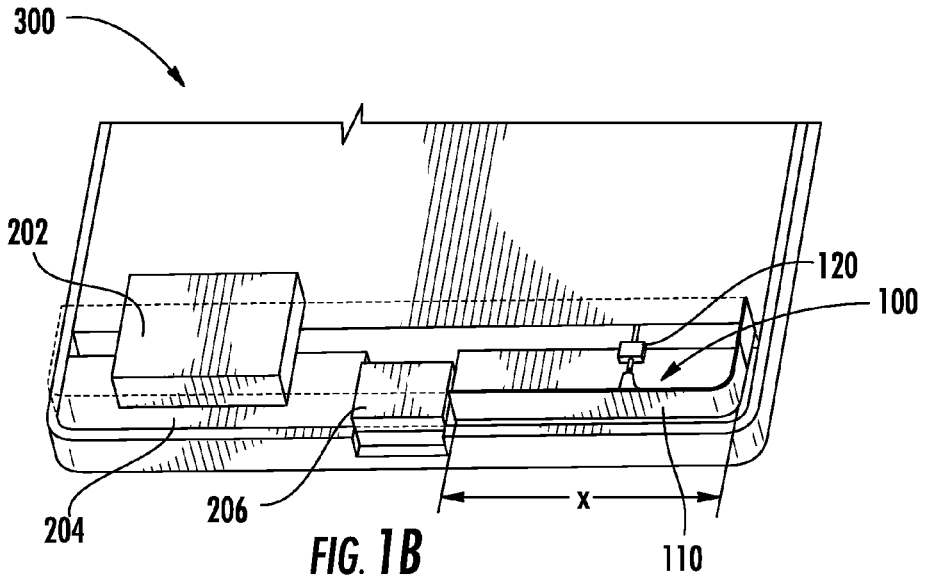
FIG. 1*b* is a front perspective view of a portion of the mobile communication device shown in FIG. 1*a* containing some of its internal components, including a tunable antenna system according to an embodiment of the presently disclosed subject matter.

In one aspect, the present subject matter provides a tunable antenna system that includes an electrically small antenna and a tunable band-stop circuit in series with the antenna. Specifically, as illustrated in FIGS. 1*a* and 1*b*, the tunable antenna system, generally designated 100, can be contained on an antenna carrier 200 along with any of a variety of additional components. In the embodiment shown in FIG. 1*b*, for example, antenna carrier 200 can further hold a speaker 202, a non-grounded printed circuit board 204, and an external connection port 206 (e.g., USB port). In addition, as shown in FIG. 1*a*, antenna carrier 200 can be integrated into a mobile device 300 and can be connected to a main printed circuit board 302 of the device. As can be seen from this exemplary configuration, the amount of space available for tunable antenna system 100 can comprise a relatively small portion of the overall volume of mobile device 300.

To advantageously make use of this limited component space, tunable antenna system 100 can comprise an electrically small antenna 110 (e.g., a small monopole radiator), which can have a largest dimension x that is substantially equal to or less than one-tenth of a length of a wavelength corresponding to a frequency within a communications operating frequency band. In particular, electrically small antenna 110 can be sized such that largest dimension x is substantially equal to or less than one-tenth of a length of a wavelength corresponding to an operating frequency within a desired low-frequency band. In one particular embodiment, for example, electrically small antenna 110 can be a single feed monopole having a pattern length of about 1 inch and a pattern width that is as wide as possible for the device volume to increase bandwidth.

Despite this small size, electrically small antenna 110 can still be of appropriate dimensions to yield a strongly-radiating resonance at a desired high-frequency band. In some exemplary embodiments, for instance, electrically small antenna 110 can be a monopole radiator that is sized to have a real resonance between about 2.2 GHz and 2.5 GHz, and electrically small antenna 110 can have a real resistance greater than about 200 Ω.

Figure 2:
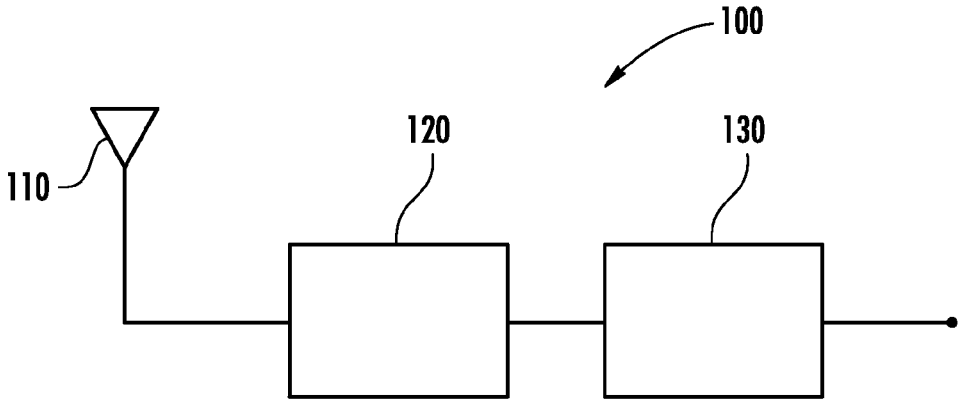
FIG. 2 is a schematic diagram illustrating a tunable antenna system according to embodiments of the presently disclosed subject matter.
Figure 3:
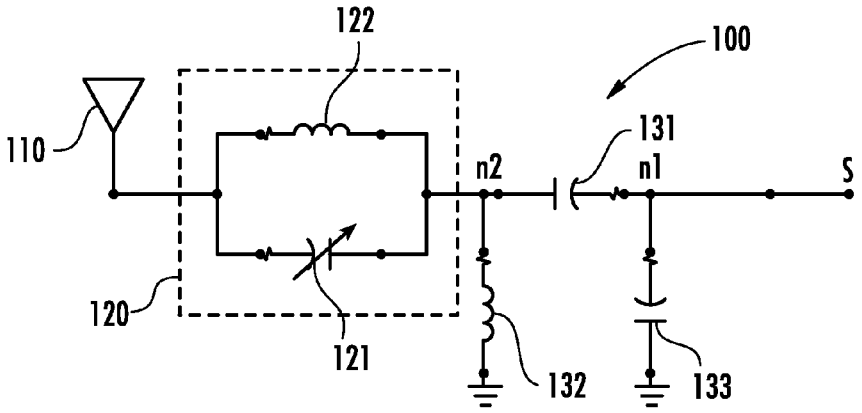
FIGS. 3 through 5 are circuit diagrams illustrating exemplary configurations for a tunable antenna system according to embodiments of the presently disclosed subject matter.

With respect to low-band frequencies, however, an antenna of this length generally is not resonant at the low-band operating frequency upon which its length was determined as discussed above. Accordingly, a resonance control element 130 can be provided between electrically small antenna 110 and a signal node S as shown in FIG. 2. Resonance control element 130 can comprise one or more reactive circuit element configured to offset the reactance of electrically small antenna 110. In some embodiments, for example, where electrically small antenna 110 exhibits primarily capacitive reactance at non-resonant frequencies, resonance control element 130 can comprise a shunt inductor 132 provided between a second node n2 connected between electrically small antenna 110 and signal node S and a ground as shown in each of the embodiments of FIGS. 3 and 4. In some embodiments, shunt inductor 132 can have an inductance (e.g., between about 2.7 and 6.8 nH) that is selected to achieve a low-band resonance (e.g., about 1.2 GHz) from the impedance of electrically small antenna 110. In this arrangement, shunt inductor 132 can be configured to provide low-band resonance, although such a configuration is generally not matched well.

To improve the matching of electrically small antenna 110, tunable antenna system 100 can further include a tunable band-stop circuit, generally designated 120, which can be configured to form a band-stop zone between low and high bands. Specifically, for example, in one embodiment illustrated in FIG. 3, tunable band-stop circuit 120 can comprise a parallel resonant circuit having a tunable capacitor 121 connected in parallel with a band-stop inductor 122, with this parallel arrangement being provided in series between electrically small antenna 110 and signal node S. In particular, tunable capacitor 121 can be one of a micro-electro-mechanical systems (MEMS) variable capacitor, a semiconductor switch-based variable capacitor (e.g. silicon-on-insulator (SOI), GaAs PHEMT), a Barium Strontium Titanate (BST) variable capacitor, or a varactor diode. Regardless of the particular form of tunable capacitor 121, it can have a tuning range (e.g., ΔC of about 4 pF) that allows it to be set to any of a range of values (e.g., from as low as about 1 pF or lower or as high as 8 pF or higher) that is selected to cover the desired range of band-stop frequencies (e.g., centered around a band-stop resonance of about 1.5 GHz).

Furthermore, in some embodiments, band-stop inductor 122 can be fixed in value, but when taken in combination with tunable capacitor 121, tunable band-stop circuit 120 can exhibit a range of inductances (e.g., between about 2.7 and 6.8 nH) designed to achieve the desired band-stop effect.

Figure 4:
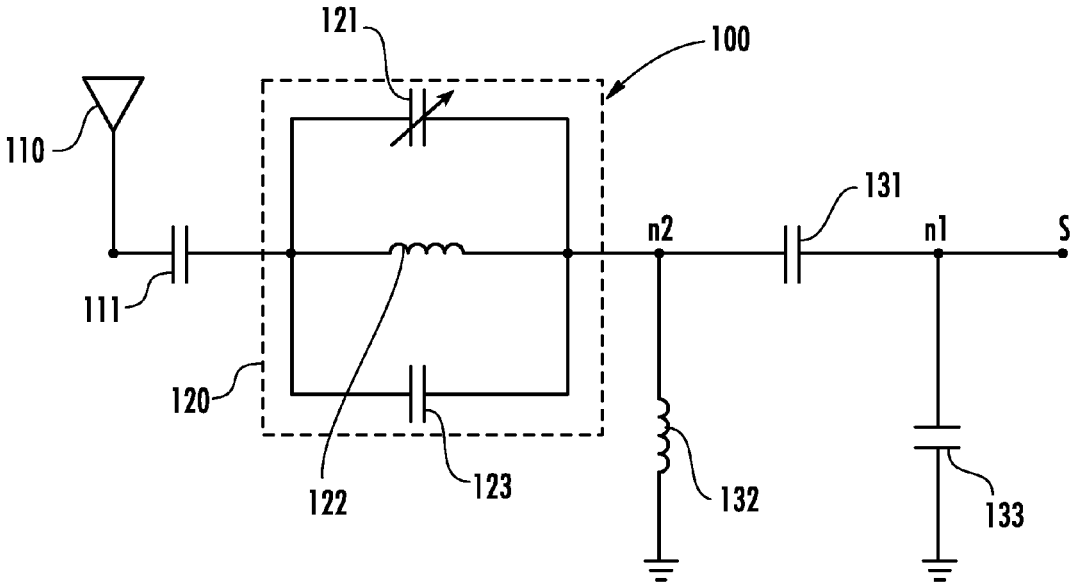

In addition, in some embodiments, a fixed capacitor 123 can further be provided in parallel with tunable capacitor 121 and with band-stop inductor 122 as illustrated in FIG. 4. In such configurations, the capacitance provided by fixed capacitor 123 (e.g., between about 0 and 4 pF) can be designed to increase the minimum capacitance of tunable band-stop circuit 120, which can thereby allow that tunable capacitor 121 only need be tunable within the range between a desired lower tuning capacitance and a desired upper tuning capacitance.

Figure 5:
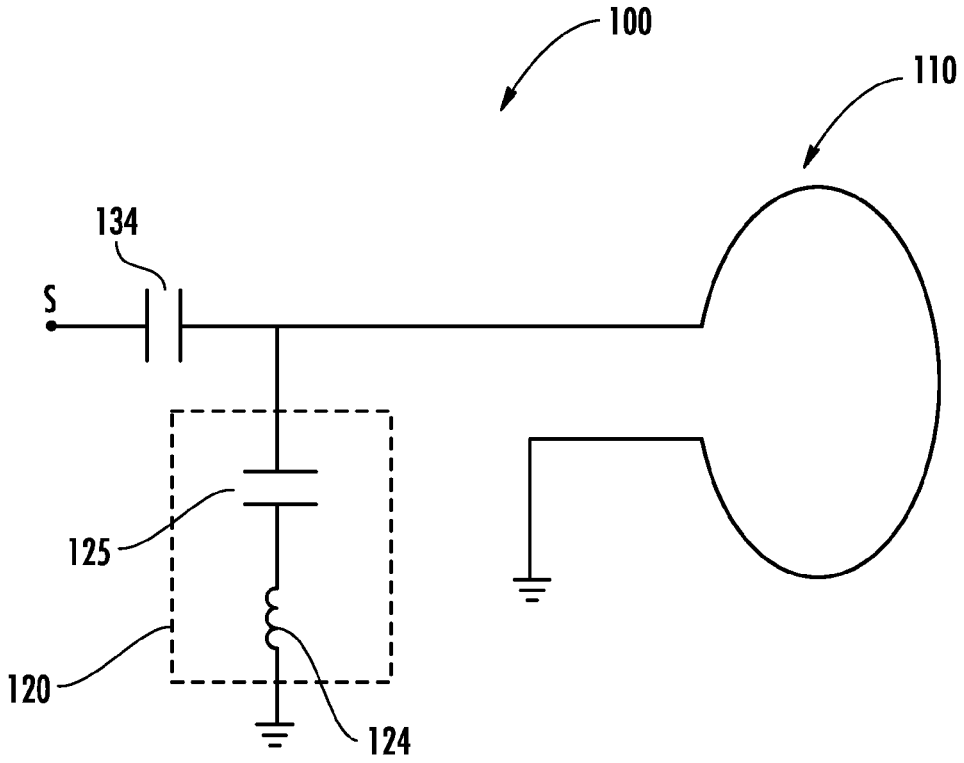

In another configuration shown in FIG. 5, electrically small antenna 110 can comprise a loop inductive antenna (e.g., either differential or single-ended. To provide a stop band tuning circuit for such an antenna configuration, tunable band-stop circuit 120 can comprise a series L-C circuit connected in parallel with the loop. As shown in FIG. 5, for example, tunable band-stop circuit 120 can comprise a shunt band-stop inductor 124 in series with a shunt band-stop capacitor 125, which can be configured to resonate with and tune the loop antenna at low-band frequencies below the stop-band created by the "short" to ground formed by tunable band-stop circuit 120. In contrast, at high-band frequencies, tunable band-stop circuit 120 would look high-impedance inductive in parallel with electrically small antenna 110. To optimize the match, resonance control element 130 in this embodiment can comprise a series capacitor 134 positioned between tunable band-stop circuit 120 and signal node S. In this configuration, tunable antenna system 100 can exhibit advantages, for example, for FM/UHF antennas combined with cellular applications.

Figure 6A:
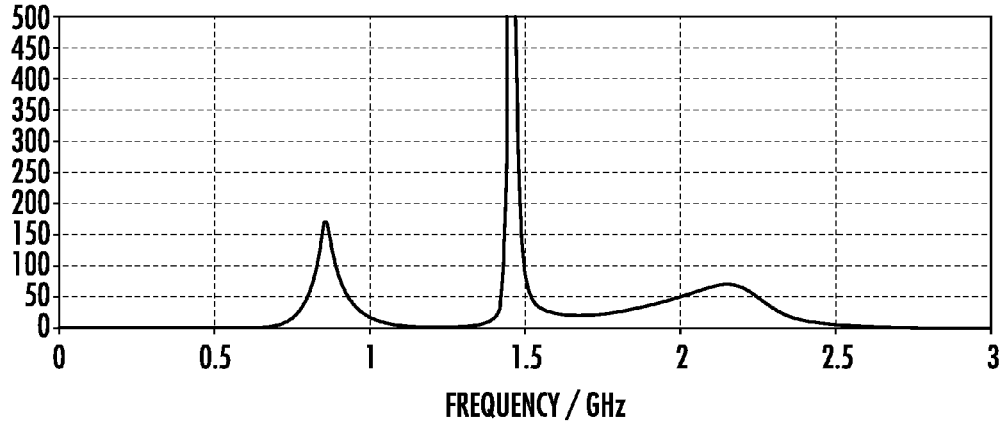
FIG. 6*a* is a graph showing the real part of circuit input impedance as a function of frequency according to an embodiment of the presently disclosed subject matter.
Figure 6B:
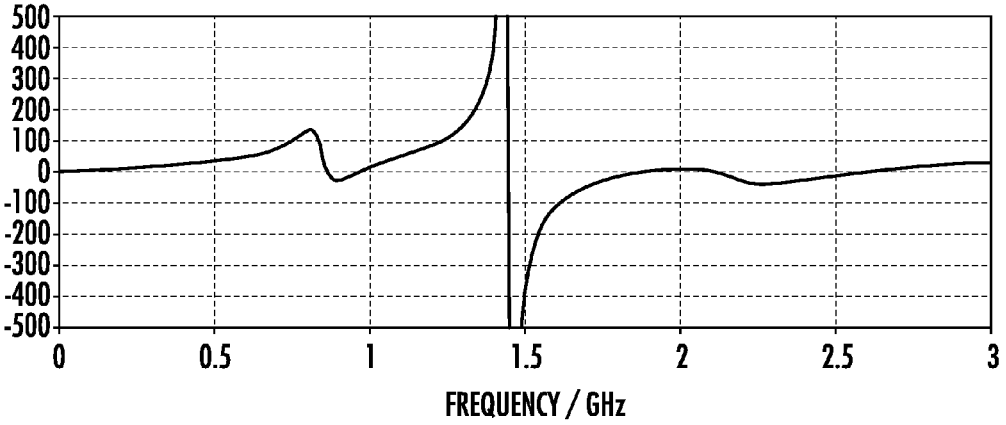
FIG. 6*b* is a graph showing the imaginary part of circuit input impedance as a function of frequency according to an embodiment of the presently disclosed subject matter.

Regardless of the particular configuration of tunable antenna system 100 generally or of tunable band-stop circuit 120 in particular, the matching topology can be designed to use as few as one tunable element (e.g., tunable capacitor 121) to control antenna impedance simply and clearly. (See, e.g., FIGS. 6*a* and 6*b*) Those having skill in the art will recognize that more tuners can be added into the matching network, which can result in tunability being expanded in low- and high-bands, but parasitic values of such additional tuners can affect the impedance.

Even with just one tunable capacitor as a part of tunable band-stop circuit 120, however, the band-stop zone can be adjusted up and down (e.g., by tuning tunable capacitor 121). Such shifts in the band-stop frequency can strongly affect a system resonance for tunable band-stop filter 120 and electrically small antenna 110 within a desired low frequency band below a band-stop frequency, but there can be little or no impact to a system resonance within a desired high frequency band above the band-stop frequency. In this regard, for example, band-stop inductor 122 can be configured to resonate with electrically small antenna 110 at low-band frequencies, but tunable capacitor 121 can be configured to tune the effective inductance of tunable band-stop circuit 120, which thereby allows tunable band-stop circuit to tune the low-band response. In contrast, at high-band frequencies, tunable capacitor 121 (and fixed capacitor 122, if present) becomes effectively "transparent," and electrically small antenna 110 operates as though there were no tuning circuit.

Figure 7:
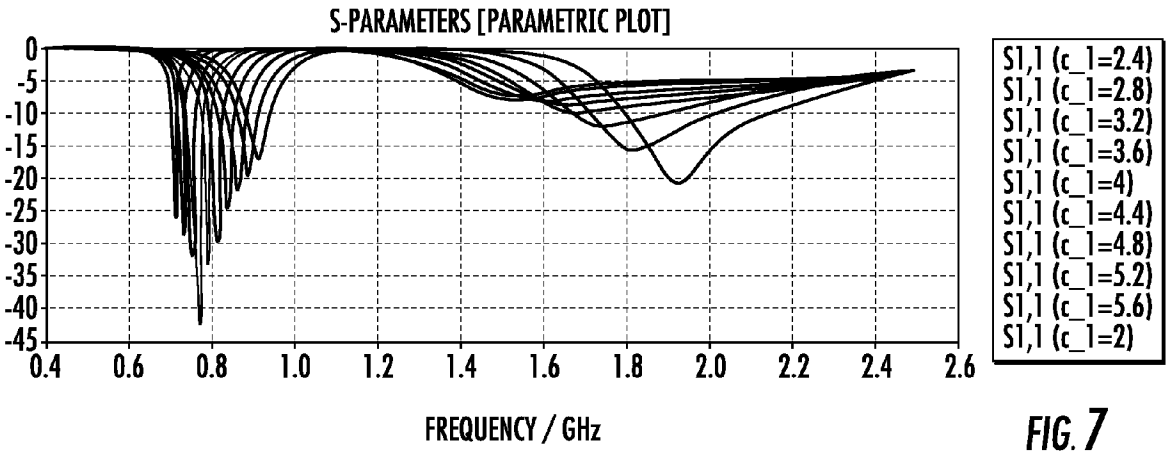
FIG. 7 is a graph showing the reflected power of a tunable band-stop circuit as a function of frequency over a range of tuning settings according to an embodiment of the presently disclosed subject matter.

For example, as shown in FIG. 7, using one variable capacitor in tunable band-stop filter 120, tunable antenna system 100 can cover a wide range of low-band frequencies (e.g., between 700 MHz and 900 MHz) with concurrent high-band resonance. In this configuration, the configurations discussed herein are technically not self-resonant antenna configurations but are instead more accurately described as reactance-matched antennas. Thus, the arrangements disclosed herein can be sensitive to peripheral elements that can affect the antenna impedance and feeding structure, but they should not exhibit any significant parasitic resonance.

In this way, this arrangement of electrically small antenna 110 and tunable band-stop circuit 120 can provide high tunability of the low-band frequencies by shifting the band-stop frequency to help match the antenna impedance in the desired low-band frequency range.

Figure 8:
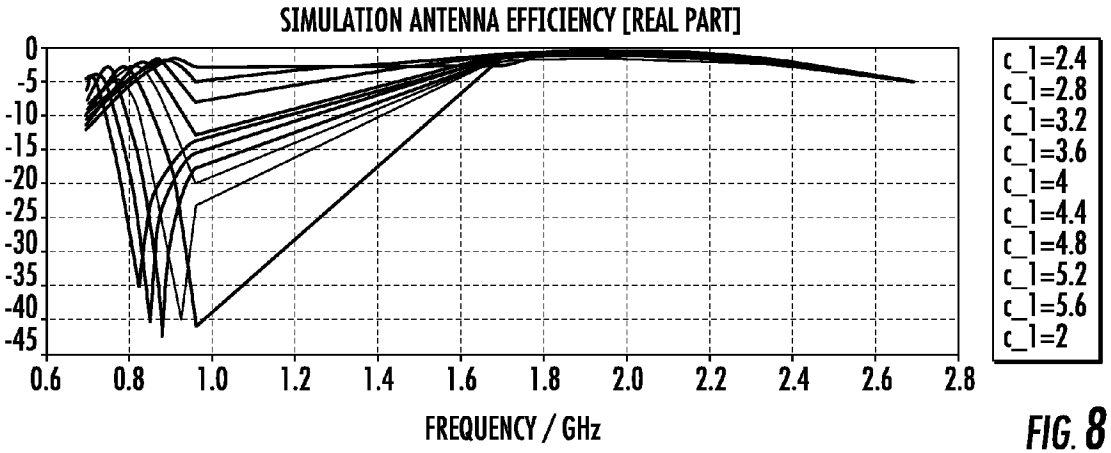
FIG. 8 is a graph showing simulated antenna efficiency for a tunable antenna system as a function of frequency over a range of tuning settings according to an embodiment of the presently disclosed subject matter.

In addition, tunable band-stop circuit 120 can also help to broaden the bandwidth of a high frequency operating band, and it can help to increase antenna efficiency in both low- and high-band operation. As shown in FIG. 8, for example, tunable antenna system 100 can exhibit high efficiency in both low- and high-band operation, with high-band efficiency being relatively steady while the low-band is shifting. Tunable band-stop circuit 120 can further make radiation power concentrated into both sides of the band-stop zone, since the band-stop zone doesn't store radiation power, but instead spreads the energy into the both low and high resonances (i.e., "balloon" effects). In this way, tunable antenna system 100 can provide a tunable antenna solution for advanced mobile technology (e.g., LTE, LTE-A, and 5G) to achieve a wide bandwidth with a small antenna volume.

In addition to the combination of elements discussed above, tunable antenna system 100 can further include one or more elements to improve the operational characteristics of the system. Specifically, for example, to allow further tailoring of the high frequency band at which tunable antenna system 100 is resonant, in some embodiments, a resonance control capacitor 133 can be provided in a shunt arrangement between a first node n1 connected between electrically small antenna 110 and a signal node S and a ground as shown in each of the embodiments of FIGS. 3 and 4. In some embodiments, resonance control capacitor 133 can provide a fixed capacitance (e.g., about 1.2 pF) selected such that, when taken together with the length of tunable antenna system 100, tunable antenna system 100 can achieve a resonance at a desired high frequency band within the communications operating band. Alternatively, resonance control capacitor 133 can be tunable to allow tunable antenna system 100 to tune any of a range of high-band frequencies by adjusting a capacitance setting of resonance control capacitor 133. In any form, in embodiments where a resonance control capacitor 133 is provided in tunable antenna system 100 for high-band resonance control, the combination of shunt inductor 132 and resonance control capacitor 133 can together be adapted to control tunable antenna system 100 to have a desired combination of low- and high-band resonance (e.g., low resonance at about 1 GHz and high resonance at about 2 GHz).

Furthermore, in some embodiments, a high-band bandwidth control capacitor 131 can further be provided in communication with electrically small antenna 110. In particular, bandwidth control capacitor 131 can be provided in series between electrically small antenna 110 and signal node S (e.g., between electrically small antenna 110 and first node n1). In some embodiments, bandwidth control capacitor 131 can have a capacitance (e.g., about 33 pF) selected to achieve a desired bandwidth of a desired high frequency band. Also, in some embodiments, an electrostatic discharge protection capacitor 111 (e.g., a fixed element having a capacitance of about 33 pF) can be provided in communication with electrically small antenna 110. (See, e.g., FIG. 4)

In summary, compelling tunable performance can be achieved with this concept, consisting of low-band tunability with good efficiency along with a stable high band resonance having high efficiency and wide bandwidth. This is particularly useful for handover monitoring and for low-high and high-high carrier aggregation applications.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. A tunable antenna system comprising:

an electrically small antenna having a largest dimension that is substantially equal to or less than one-tenth of a length of a wavelength corresponding to a frequency within a range of low-band frequencies; and a tunable band-stop circuit connected between the electrically small antenna and a signal node, the tunable band-stop circuit being tunable to adjust a band-stop frequency that is higher than the low-band frequencies but is lower than a range of high-band frequencies;

wherein adjustment of the band-stop frequency helps to match an impedance of the electrically small antenna within the low-band frequencies while maintaining high antenna efficiency in the high-band frequencies.

2. The tunable antenna system of claim 1, wherein the tunable band-stop circuit comprises:

a tunable capacitor connected between the electrically small antenna and the signal node; and a band-stop inductor connected in parallel with the tunable capacitor between the electrically small antenna and the signal node, the band-stop inductor having a band-stop inductance selected to achieve the desired band-stop frequency.

3. The tunable antenna system of claim 2, wherein the tunable capacitor comprises a variable capacitor selected from the group consisting of a micro-electro-mechanical systems (MEMS) variable capacitor, a semiconductor switch-based variable capacitor, a Barium Strontium Titanate (BST) variable capacitor, or a varactor diode.

4. The tunable antenna system of claim 2, wherein in tunable operation the tunable capacitor is tunable to adjust a capacitance of the band-stop circuit within a range of about 4 pF.

5. The tunable antenna system of claim 2, wherein the tunable band-stop circuit comprises a capacitor connected in parallel with the tunable capacitor and the band-stop inductor between the electrically small antenna and the signal node, the capacitance of the fixed capacitor is selected to achieve a desired minimum capacitance of the tunable band-stop circuit.

6. The tunable antenna system of claim 1, comprising a reactive circuit element in communication between the tunable band-stop circuit and the signal node, the reactive circuit element having a reactance selected to achieve a system resonance for the tunable band-stop circuit and the electrically small antenna within the low-band frequencies below the band-stop frequency.

7. The tunable antenna system of claim 6, wherein the reactive circuit element comprises an inductor connected in a shunt arrangement with a first terminal of the inductor being connected between the tunable band-stop circuit and the signal node and a second terminal of the inductor being connected to a ground.

8. The tunable antenna system of claim 1, comprising an electrostatic discharge protection capacitor connected between the electrically small antenna and the tunable band-stop circuit.

9. The tunable antenna system of claim 1, comprising a bandwidth control capacitor connected between the tunable band-stop circuit and the signal node, the bandwidth control capacitor having a series capacitance selected to achieve a desired bandwidth within the high-band frequencies above the band-stop frequency.

10. The tunable antenna system of claim 1, comprising a resonance control capacitor having a first terminal connected between the tunable band-stop circuit and the signal node and a second terminal connected to a ground, the resonance control capacitor having a shunt capacitance selected to achieve a resonance within the high-band frequencies above the band-stop frequency.

11. A method for tuning an electrically small antenna, the method comprising:

connecting a tunable band-stop circuit between an electrically small antenna and a signal node, the electrically small antenna having a largest dimension that is substantially equal to or less than one-tenth of a length of a wavelength corresponding to a frequency within a range of low-band frequencies; and tuning the tunable band-stop circuit to adjust a band-stop frequency between a the low-band frequencies and a desired range of high-band frequencies;

wherein adjustment of the band-stop frequency helps to match an impedance of the electrically small antenna within the low-band frequencies while maintaining high antenna efficiency in the high-band frequencies.

12. The method of claim 11, wherein connecting a tunable band-stop circuit between an electrically small antenna and a signal node comprises connecting a tunable capacitor and a band-stop inductor in parallel between the electrically small antenna and the signal node, the band-stop inductor having a band-stop inductance selected to achieve the desired band-stop frequency; and wherein selectively tuning the tunable band-stop circuit comprises tuning a capacitance of the tunable capacitor.

13. The method of claim 12, wherein connecting a tunable band-stop circuit between an electrically small antenna and a signal node further comprises connecting a fixed capacitor in parallel with the tunable capacitor and the band-stop inductor between the electrically small antenna and the signal node, the fixed capacitor having a parallel capacitance selected to achieve a desired minimum capacitance of the tunable band-stop circuit.

14. The method of claim 11, comprising connecting a reactive circuit element in communication between the tunable band-stop circuit and the signal node, the reactive circuit element having a reactance selected to achieve a system resonance within the low-band frequencies below the band-stop frequency.

15. The method of claim 14, wherein the reactive circuit element comprises an inductor.

16. The method of claim 11, comprising connecting an electrostatic discharge protection capacitor between the electrically small antenna and the tunable band-stop circuit.

17. The method of claim 11, comprising connecting a bandwidth control capacitor between the tunable band-stop circuit and the signal node, the bandwidth control capacitor having a series capacitance selected to achieve a desired bandwidth within the high-band frequencies.

18. The method of claim 11, comprising connecting a resonance control capacitor in communication between the tunable band-stop circuit and the signal node, the resonance control capacitor having a first terminal connected between the tunable band-stop circuit and the signal node and a second terminal connected to a ground, the resonance control capacitor having a shunt capacitance selected to achieve a resonance within the high-band frequencies.

* * * * *